US009839928B2

(12) United States Patent
Park

(10) Patent No.: US 9,839,928 B2
(45) Date of Patent: Dec. 12, 2017

(54) PUMPING CONTAINER FOR BLOCKING AIR

(71) Applicant: Kook Sir Park, Gunpo-si (KR)

(72) Inventor: Kook Sir Park, Gunpo-si (KR)

( * ) Notice: Subject to any disclaimer, the term of this patent is extended or adjusted under 35 U.S.C. 154(b) by 0 days.

(21) Appl. No.: 14/646,467

(22) PCT Filed: Jun. 18, 2014

(86) PCT No.: PCT/KR2014/005325
§ 371 (c)(1),
(2) Date: May 21, 2015

(87) PCT Pub. No.: WO2015/023052
PCT Pub. Date: Feb. 19, 2015

(65) Prior Publication Data

US 2015/0298150 A1 Oct. 22, 2015

(30) Foreign Application Priority Data

Aug. 14, 2013 (KR) ..... 20-2013-0006775 U

(51) Int. Cl.
*B05B 11/00* (2006.01)
*B05B 15/00* (2006.01)
(Continued)

(52) U.S. Cl.
CPC ..... *B05B 11/3047* (2013.01); *B05B 11/0043* (2013.01); *B05B 15/005* (2013.01);
(Continued)

(58) Field of Classification Search
CPC ..... B65D 83/62; B65D 5/60; B65D 25/20; B65D 35/28; B65D 35/56; B65D 47/06;
(Continued)

(56) References Cited

U.S. PATENT DOCUMENTS 2,063,430 A * 12/1936 Graser ..... B05B 9/047 222/386.5
3,300,102 A * 1/1967 Budzich ..... B67D 1/045 222/386.5
(Continued)

FOREIGN PATENT DOCUMENTS

JP 08-133358 A 5/1996
JP 11-059726 A 3/1999
(Continued)

OTHER PUBLICATIONS

International Searching Authority, International Search Report for PCT/KR2014/005325 dated Jul. 3, 2014.
(Continued)

*Primary Examiner* — Nicholas J Weiss
*Assistant Examiner* — Andrew P Bainbridge
(74) *Attorney, Agent, or Firm* — Paratus Law Group, PLLC

(57) ABSTRACT

A pumping container for blocking air comprises: a container for accommodating liquid contents; a pumping cap, coupled to an inlet of the container, for discharging the contents accommodated in the container to the outside according to a pumping operation; a suction line, coupled to the pumping cap, for sucking in the contents according to the operation of a pumping part; and an air blocking member for preventing the contents remaining in the container from making contact with air, by receiving and collecting air on the inside thereof in a volume equal to that of the contents discharged from the container by the pumping operation. Since the pumping container for blocking air, configured as described above, can always keep the contents accommodated in the container sealed from the outside so as not to be in contact with air, it is possible to prevent the problem of the shelf life of the
(Continued)

contents rapidly shortening due to the decomposition or oxidation by contamination of the contents.

2 Claims, 2 Drawing Sheets

(51) Int. Cl.

| | |
|---|---|
| *B65D 35/14* | (2006.01) |
| *B65D 47/06* | (2006.01) |
| *B65D 5/60* | (2006.01) |
| *B65D 83/62* | (2006.01) |
| *A45D 34/00* | (2006.01) |

(52) U.S. Cl.
CPC ..... *A45D 34/00* (2013.01); *A45D 2200/056* (2013.01); *B65D 5/60* (2013.01); *B65D 35/14* (2013.01); *B65D 47/06* (2013.01); *B65D 83/62* (2013.01)

(58) Field of Classification Search
CPC ..... B65D 83/00; B65D 35/14; B05B 11/3047; B05B 11/0043; B05B 15/005; A45D 34/00
USPC ..... 222/92–107, 321.1, 321.7–321.9, 383.1, 222/386.5, 464.1–464.7
See application file for complete search history.

(56) References Cited

U.S. PATENT DOCUMENTS 4,265,373 A * 5/1981 Stoody ..... B65D 83/62 222/386.5
4,763,818 A * 8/1988 Stefano ..... A47K 5/1211 222/209
4,865,224 A * 9/1989 Streck ..... B65D 83/0055 222/1
5,499,758 A * 3/1996 McCann ..... B67D 1/045 222/386.5
5,630,531 A * 5/1997 Gaucher ..... B05B 11/0016 222/105
5,797,517 A * 8/1998 Weinstein ..... B05B 11/061 222/105
5,813,571 A * 9/1998 Gaucher ..... B05B 11/0043 222/105
5,934,500 A * 8/1999 Cogger ..... B65D 23/02 215/12.1
7,395,949 B2 * 7/2008 Ehret ..... B67D 1/045 215/231
8,464,908 B1 * 6/2013 Tabor ..... B65D 51/1644 222/105
2011/0062185 A1 * 3/2011 McFarland ..... B05B 11/0043 222/105
2015/0298150 A1 * 10/2015 Park ..... B05B 11/0043 222/383.1

FOREIGN PATENT DOCUMENTS

KR 10-2000-0058455 A 10/2000
KR 10-2006-0090790 A 8/2006
KR 10-0858320 B1 9/2008

OTHER PUBLICATIONS

Korean Intellectual Property Office, Korean Office Action for KR 20-2013-0006775 dated Oct. 1, 2013.
Korean Intellectual Property Office, Notice of Allowance for KR 20-2013-0006775 dated Dec. 24, 2013.

* cited by examiner

PUMPING CONTAINER FOR BLOCKING AIR

TECHNICAL FIELD

The present invention relates to a pumping container, and more particularly, to an air-blocking type pumping container in which contents accommodated in the container is kept in a sealed condition.

BACKGROUND ART

In general, fluid including cosmetics such as lotion and toner, perfumes, shampoo, rinse and liquid detergent etc. is mostly contained and stored in a certain container, and is discharged in a fixed amount through an inlet of the container and used, if required.

At this time, a pumping cap is used which includes a pumping part performing an up-and-down pumping movement to discharge the liquid contents accommodated in the container in a fixed amount, and the container including the pumping cap thus performing the up-and-down pumping movement is called a pumping container.

The pumping container discharges a fixed amount of the contents to the outside of the container whenever the pumping part of the pumping cap is pressed once, and therefore, effects can be expected that unnecessary use of the fluid can be prevented and that ingress of foreign matters into the container can be prevented as the container does not need to be opened when using the fluid contents. Furthermore, in a case where volatile components are contained in the fluid contents accommodated in the container, emission of volatile substance into the atmosphere due to opening of the container can be blocked. Therefore, an effected is provided that the change of components of the fluid contents can be prevented, and therefore the pumping container is a useful article of which use and propagation are gradually increased.

A prior art regarding a pumping container for such a use is disclosed in Korean Laid-Open Patent Application No. 10-2013-0070023.

The pumping container of the prior art includes a main body for accommodating the contents, a pumping part coupled to an inlet of the container and including a pressing element and a pipe member, and a suction line connected to the pumping part.

In the case of the prior pumping container with the above-mentioned construction, when the contents are discharged or spurted to be used by operating the pipe member of the pumping part, external air may be introduced into the container in a volume corresponding to a used amount of the contents.

When the contents present in the pumping container contact with the introduced air thus, the contents may be denatured by bacteria, molds or microorganism etc. contained in the air. Furthermore, there is a problem that the contents is simultaneously oxidization-denatured by the oxygen contained in the when stored for a long period of time.

SUMMARY OF THE INVENTION

Technical Problem

Therefore, an object of the present invention for solving the above-mentioned problems is to provide an air-blocking type pumping container which includes an air blocking member for preventing beforehand the contents remaining in the container from contacting with the introduced air, by receiving and collecting the air introduced into the inside of the blocking member in a volume equal to that of the contents discharged from the container.

Solution to the Problem

An air-blocking type pumping container for achieving the above-mentioned object of the present invention includes a container for accommodating liquid contents; a pumping cap coupled to an inlet of the container and for discharging the contents accommodated in the container according to pumping operation; a suction line coupled to the pumping cap and for sucking the contents accommodated in the container according to operation of a pumping part; and an air blocking member for preventing beforehand the contents remaining in the container from contacting with the introduced air, by receiving and collecting the air introduced into the inside of the air blocking member in a volume equal to that of the contents discharged from the container by the pumping operation.

According to an embodiment of the air-blocking type pumping container, in the pumping cap an air inlet is formed through which external air can be introduced into the inside of the air blocking member in the pumping operation.

As an example, the air-blocking member is an air collection part having a size such that the air collection pare can fully fill the inside of the container when expanded and accommodates the suction line and the pumping part of the pumping cap, wherein a lower end of the air blocking member is coupled to a lower part of the suction line such that a suction opening of the suction line is exposed and an upper end of the air blocking member is closely contactingly fixed to a lower surface of the coupling cap of the pumping cap facing the inlet of the container.

As another example, the air blocking member has a lower part which surrounds the suction line while exposing the suction opening of the suction line, and an upper part which is closely contactingly and integrally fixed to the lower surface of the coupling cap of the pumping cap facing the inlet of the container while surrounding the pumping part of the pumping cap, and the air blocking member is an air collection part which is expanded so as to collect the air in a volume equal to that of the discharged contents.

Effects of the Invention

The air-blocking type pumping container having the construction described above can prevent beforehand the contents remaining in the container from contacting with the introduced air, by receiving the air introduced into the inside of the blocking member in a volume equal to that of the used contents accommodated in the container.

That is to say, the air-blocking type pumping container can keep the contents accommodated in the container sealed off from the outside by the blocking member so that the contents do not contact with the air, and therefore, a problem can be prevented that the contents are contaminated or oxidized and thus the shelf life of the contents is rapidly shortened.

Furthermore, such an air-blocking type pumping container can prevent beforehand the fluid contents accommodated therein from contacting with the air, and thus can be more effectively used as a container for natural cosmetics with no antiseptic or preservative.

BEST MODES FOR CARRYING OUT THE INVENTION

Figure 1:
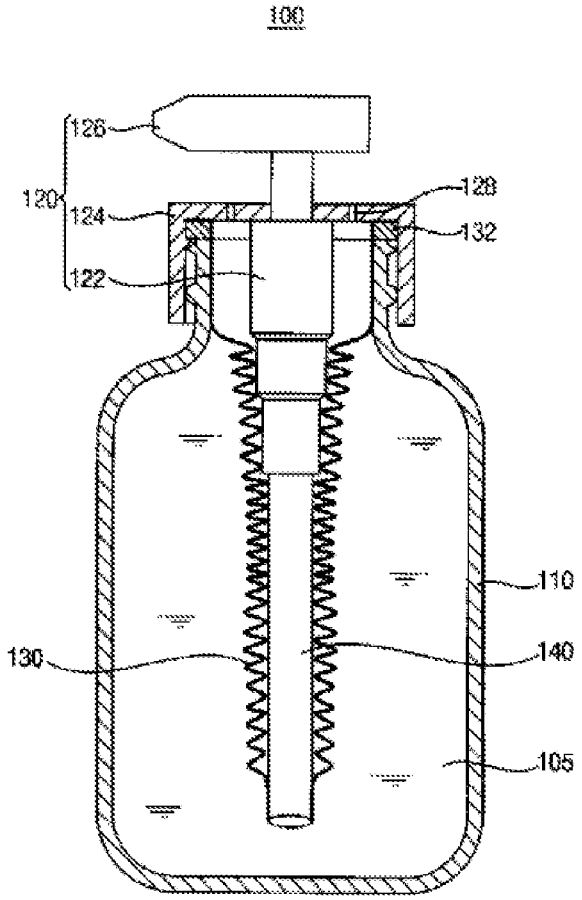
FIG. 1 is a cross-sectional view schematically showing an air-blocking type pumping container according to an embodiment of the present invention.

An air-blocking type pumping container of the present invention includes a container for accommodating liquid contents; a pumping cap coupled to an inlet of the container and for discharging the contents accommodated in the container according to pumping operation; a suction line coupled to the pumping cap and for sucking the contents according to the pumping operation; and an air blocking member for preventing beforehand the contents remaining in the container from contacting with the introduced air, by receiving and collecting the air introduced into the inside of the air blocking member in a volume equal to that of the contents discharged from the container by the pumping operation.

In the following, an air-blocking type pumping container according to an embodiment of the present invention will be described with reference to the attached drawings. The present invention may be subject to various modifications and may have various forms. Specific embodiments are illustrated in the drawings and described in detail in the text. However, this is not intended to limit the present invention to a specific form disclosed, and the present should be understood to cover all of modifications, equivalents and substitutes included within the concept and technical scope of the present invention. Like elements are designated by like reference numerals in each figure. In the attached drawings, the dimensions of parts are exaggerated compared to actual dimensions for the sake of clarity of the present invention.

The terms "a first ~", "a second ~" etc. may be used for describing various elements, but the elements should not be limited by the terms. The terms are used only for the purpose of distinguishing one element from another element. For example, a first element may be named a second element and similarly, a second element may be named a first element, without departing from the scope of claims of the present invention.

Terms used in the present application are used to only describe a specific embodiment and are not intended to limit the present invention. Expression in the singular form includes expression in the plural form unless otherwise stated explicitly in the context. In the present application, it should be understood that terms such as "comprise (or include)", "have" etc. and derivatives thereof designate the presence of features, numbers, steps, actions, elements, parts or combinations thereof stated in the specification and do not previously exclude a possibility of presence or addition of one or more other features, numbers, steps, actions, elements, parts or combinations thereof.

Meanwhile, unless otherwise defined, all terms used herein including technical or scientific terms have the same meaning as that commonly understood by those skilled in the art.

Terms as defined in a dictionary usually used should be interpreted to have their meaning identical to contextual meaning of related art, and are not interpreted as ideal or excessive formal meaning unless explicitly defined in the application.

FIG. 1 is a cross-sectional view schematically showing an air-blocking type pumping container according to an embodiment of the present invention.

Referring to FIG. 1, the air-blocking type pumping container (100) according to the embodiment of the present invention includes a container (110) for accommodating liquid contents (105), a pumping cap (120) for discharging the accommodated contents to the outside by pumping operation, a suction line (140) for sucking the contents according to the pumping operation, and an air-blocking member (130) for preventing beforehand the contents remaining in the container from contacting with air.

The container (110) is an accommodating part having a space for accommodating the liquid contents and may be produced by injection molding. Threads capable of being engaged with the pumping cap are formed on an outer circumferential surface of an inlet of the container (110). For example, the container (110) used in the present invention may have various shapes such as circular shape, gourd bottle shape, cylindrical shape, and rectangular column shape.

The container (110) illustrated in the drawings is merely one example and containers of various shapes such as various cosmetics containers, shampoo containers, spray containers etc. may be employed. Furthermore, the contents accommodated in the container are material of liquid state and may include cosmetics, food and beverage, shampoo etc.

The pumping cap (120) is coupled with the inlet of the container (110) and is configured so that the liquid contents accommodated in the container can be discharged to the outside according to the pumping operation of a pumping part (122).

For example, the pumping cap (120) used in the present invention may have the same structure as widely used conventional pumping caps, and may mainly include a pumping head (126), the pumping part (122) and a coupling cap (124) for fixing the pumping part to the container.

In particular, the pumping cap (120) used in the air-blocking type container (100) of the present invention is characterized in that in the pumping cap an air inlet (128) is formed through which external air can be introduced into the inside of the air-blocking member (130) due to reduction of pressure in the container resulting from outward discharge of the contents by the pumping operation of the pumping part (122).

For example, the air inlet (128) extends through an upper part of the coupling cap (124) included in the pumping cap (120) and communicates with the air-blocking member (130).

The suction line (140) is connected to an end of the pumping part (122) of the pumping cap and has a length such that the contents accommodated in the container (110) can pass through a suction opening of the suction line and then be completely discharged to the outside through the pumping head (126) included in the pumping cap by the pumping operation of the pumping part included in the pumping cap.

The blocking member (130) serves to prevent beforehand the contents (105) remaining in the container from contacting with the introduced air, by receiving and collecting the air introduced into the inside of the blocking member in a volume equal to that of the contents discharged from the container (110) by the pumping operation.

For example, the air-blocking member (130) is provided inside the container (110) in order to keep the contents accommodated in the container (110) sealed off from the outside and is an air collection pocket having a structure of being expanded by receiving the air introduced into the inside of the pocket in a volume equal to that of the contents (105) discharged from the container by the pumping operation of the pumping part (122) included in the pumping cap (120). For example, the air collection pocket may be produced as plastic bag.

More particularly, the air-blocking member (130) of the present invention is the air collection pocket having a size such that the pocket can fully fill the inside of the container (110) when expanded and has a size allowing the suction line (140) and the pumping part of the pumping cap (120) to be accommodated in the blocking member. A lower end of the blocking member is integrally coupled or fixed to an outer surface of a lower part of the suction line (140) such that the suction opening of the suction line is exposed and an upper end of the blocking member is closely contactingly fixed to a lower surface of the coupling cap of the pumping cap facing the inlet of the container (110).

At this time, the upper end of the air-blocking member (130) may be in a state where it is closely contactingly fixed and thus integrally coupled to the lower surface of the coupling cap of the pumping cap (120) by means of a close contacting member (132) such as O-ring.

Figure 2:
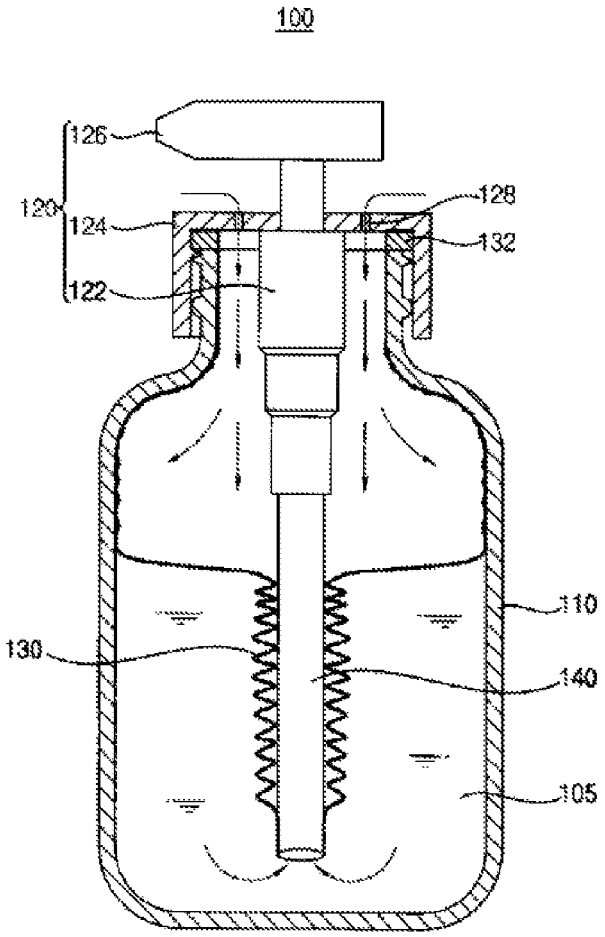
FIG. 2 is a view showing change of the state of the air-blocking member according to the discharge of the contents in the air-blocking type pumping container.

FIG. 2 is a view showing change of the state of the air-blocking member according to the discharge of the contents in the air-blocking type pumping container.

As shown in FIG. 2, the air blocking member (air collection pocket) coupled so as to surround the pumping part (122) of the pumping cap and the suction line (140) is in communication with the air inlet (128) formed in the coupling cap (124) of the pumping cap and thus can be expanded by receiving the air through the air inlet (128) in a volume equal to that of the contents discharged from the container by the pumping operation of the pumping part (122).

That is to say, the expansion of the air blocking member (130) is achieved by a fact that the air is introduced through the air inlet (128) by a force due to the reduction of pressure in the sealed container (110) occurring when discharging the contents accommodated in the container (110).

Therefore, in the case of using the contents with the use of the pumping container (100), the air is not introduced into the container, but into the inside of the air blocking member (130), and thus sealed condition can be kept which prevents the contents (105) from contacting with polluted air. By keeping the contents in the sealed condition in such a way, a problem can be prevented that the contents accommodated in the container (110) are denatured or oxidized.

INDUSTRIAL APPLICABILITY

The air-blocking type pumping container according to the present invention can be industrially applied as the containers for storing the detergent, beverage and cosmetics.

What is claimed is:

1. A container assembly comprising:

a container body for containing a liquid therein, the container body having an open top portion;

a pumping assembly coupled to the container body to block the open top portion, wherein the pumping assembly is configured to discharge the liquid in the container body via a pumping operation thereof, and includes a coupling cap coupled to the container body at the open top portion thereof, the coupling cap having at least one air hole formed therein;

a suction line fluid-communicatively coupled to the pumping assembly, wherein the suction line is disposed in the container body and is configured to suction the liquid via the pumping operation; and an air confinement and inflatable member coupled to the coupling cap, wherein the air confinement and inflatable member is received in the container body, and has an inner space fluid-communicatively coupled to the air hole, wherein the container assembly is configured such that the pumping operation of the pumping assembly enables an air to flow from an outside of the container body via the hole into the container body, wherein the air confinement and inflatable member is configured to prevent the air flowing into the container body via the pumping operation from contacting the liquid in the container body, wherein the air confinement and inflatable member is configured to be inflatable by a degree proportional to the air intake into the container body via the pumping operation, wherein the inner space of the air confinement and inflatable member is always in fluid communication with an air surrounding the container assembly through the at least one air hole which is always open, wherein the at least one air hole introduces the air surrounding the container assembly at atmospheric pressure into the inner space of the air confinement and inflatable member during the pumping operation of the pumping assembly, and wherein a lower end of the air confinement and inflatable member is integrally coupled to an outer surface of a lower part of the suction line.

2. The assembly of claim 1, wherein an O-ring is fitted between the top portion of the container body, the air confinement and inflatable member and the coupling cap.

* * * * *